United States Patent [19]

Bailey, Jr.

[11] 3,955,977

[45] May 11, 1976

[54] ELECTROSTATOGRAPHIC PROCESS

[75] Inventor: John M. Bailey, Jr., Fairport, N.Y.

[73] Assignee: Xerox Corporation, Stamford, Conn.

[22] Filed: Oct. 30, 1970

[21] Appl. No.: 85,526

[52] U.S. Cl. ..... 96/1.4; 96/1 R; 355/5

[51] Int. Cl.[2] ..... G03G 13/16; G03G 13/22

[58] Field of Search ..... 96/1, 1.4; 355/5

[56] References Cited

UNITED STATES PATENTS

| | | | |
|---|---|---|---|
| 2,979,026 | 4/1961 | Reuter | 118/637 |
| 3,013,890 | 12/1961 | Bixby | 117/17.5 |
| 3,258,525 | 6/1966 | Piatt | 178/5.4 |
| 3,265,595 | 8/1966 | Urbach | 204/18 |
| 3,288,604 | 11/1966 | Corrsin | 96/1 |
| 3,548,094 | 12/1970 | Schlein | 178/6.6 |
| 3,592,541 | 7/1971 | Gourdine | 355/17 |

FOREIGN PATENTS OR APPLICATIONS

| | | |
|---|---|---|
| 1,169,510 | 11/1969 | United Kingdom |

*Primary Examiner*—Roland E. Martin, Jr.

[57] ABSTRACT

A method is provided for electrostatographic production of a temporary graphic display and conversion thereof to permanent hard copy comprising: forming a latent electrostatic image on a photoconductive surface; contacting said surface with a transparent continuous insulating web; contacting the surface of the transparent web opposite that in contact with the latent image with electroscopic toner particles which electrostatically cling to the transparent web in conformity with said latent electrostatic image; passing the developed image on the transparent web into a viewing zone wherein said developed image can be temporarily graphically displayed; transferring said developed image to a transfer web being adapted to contact the surface of the transparent web containing the developed image, and fusing said developed image onto said transfer web thereby forming a permanent copy of said image.

An electrostatographic apparatus is provided adapted to provide a graphic display of an image and a hard copy thereof comprising: (i) an electrostatographic imaging surface; (ii) means for imposing a charge upon said imaging surface; (iii) means for imaging the charged surface to impart a latent electrostatic image thereto; (iv) developing means adapted to dispense developer; (v) a continuous transparent insulating web surrounding said developing means and being interposed between said imaging surface and said developing means thereby receiving said developer thereon in conformity with the latent electrostatic image on said imaging surface; (vi) means for viewing the image on said transparent web; and (vii) a transfer web being adapted to provide a background against which the image on said transparent web can be viewed and being further adapted to be brought into contact with said image on the transparent web to effect transfer of said image thereon.

10 Claims, 2 Drawing Figures

INVENTOR.
John M. Bailey, Jr.
BY
William Kaufman
ATTORNEY

ELECTROSTATOGRAPHIC PROCESS

This invention relates to electrostatography. More particularly, this invention relates to a method and apparatus for electrostatographically obtaining a temporary graphic display of an image and optionally obtaining a permanent hard copy thereof.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting electrostatic latent image by depositing on the image a finely-divided electroscopic material referred to in the art as "toner." The toner will normally be attracted to those areas of the layer which retain a charge, thereby forming a toner image corresponding to the electrostatic latent image. This toner image may then be transferred to a receiving surface such as paper. The transferred image may subsequently be permanently affixed to a support surface by heat. Instead of latent image formation by uniformly charging the photoconductive layer and then exposing the layer to a light-and-shadow image, one may form the latent image by directly charging the layer in image configuration. The toner image may be fixed to the photoconductive layer if elimination of the toner image transfer step is desired. Other suitable fixing means such as solvent or overcoating treatment can be substituted for the foregoing heat fixing step.

Similar methods are known for applying the electroscopic particles to the electrostatic latent image to be developed. Included within this group are the "cascade" development technique disclosed by E. N. Wise in U.S. Pat. No. 2,618,552; the "powder cloud" technique disclosed by C. F. Carlson in U.S. Pat. No. 2,221,776 and the "magnetic brush" process disclosed, for example, in U.S Pat. No. 2,874,063.

Electrostatography, as broadly described hereinabove, has heretofore been employed in preparing hard copies of original documents, microfilm, cathode-ray tube images, X-ray radiographs and the like. It is quite often necessary to scan a substantial quantity of microfilm or view many cathode-ray tube images or X-ray radiographs, but desirable to make a permanent record of relatively few of such images. Thus, the advantages in having an electrostatographic apparatus which provides means for obtaining a temporary graphic display of the image under consideration and the flexibility of obtaining a hard copy thereof, if desired, are readily apparent.

Accordingly, it is an object of the present invention to provide an electrostatographic method for obtaining a temporary graphic display of an image and for optionally obtaining a hard copy thereof.

It is another object of the present invention to provide an electrostatographic apparatus which enables a temporary graphic display of an image to be obtained and viewed and converted to a hard copy thereof, if desired.

It is still another object of the present invention to provide a method and apparatus which can be widely employed in the electrostatographic reproduction of documents, microfilm, cathoderay tube images, X-ray radiographs and the like.

These as well as other objects are accomplished by the present invention which provides a method for electrostatographic production of a temporary graphic display and conversion thereof to permanent hard copy comprising:

forming a latent electrostatic image on a photoconductive surface;

contacting said surface with a transparent continuous insulating web;

contacting the surface of the transparent web opposite that in contact with the latent image with electroscopic toner particles which electrostatically cling to the transparent web in conformity with said latent electrostatic image;

passing the developed image on the transparent web into a viewing zone wherein said developed image can be temporarily graphically displayed; and transferring said developed image to a transfer web being adapted to contact the surface of the transparent web containing the developed image, and fusing said developed image onto said transfer web thereby forming a permanent copy of said image.

Although the detailed discussion presented below makes specific reference to the use of a cathode ray tube as the image source, it should be apparent that this is for purposes of illustration only. Any conventional image source can be employed such as a document, microfilm, x-ray patterns and the like. The electrostatographic method for forming electrostatic latent images from such image sources is well known. Generally, although the "cascade" development technique is illustrated, the present invention is equally suitable for use in conjunction with the "powder cloud," "magnetic brush" and other similar conventional development techniques.

For a better understanding of the invention as well as other objects and features thereof, reference is had to the following detailed description of the invention to be read in connection with the accompanying drawing wherein.

Figure 1:
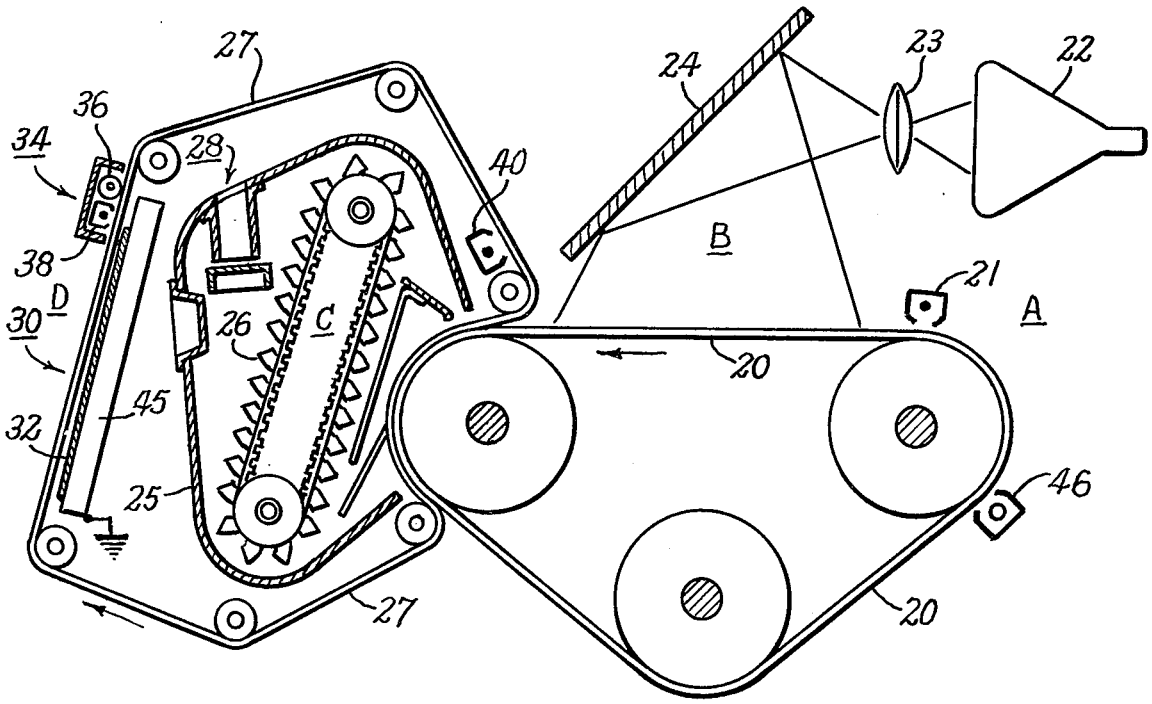
FIG. 1 is a schematic diagram in elevation of one embodiment of the apparatus of the present invention.

As shown schematically in FIG. 1, the automatic electrostatographic reproducing apparatus generally comprises an electrophotographic plate 20 including a photoconductive layer or light-receiving surface on a conductive backing and formed in the shape of an endless belt which is mounted on rollers and adapted to rotate in the direction indicated by the arrow to cause the photoconductive surface sequentially to pass a plurality of electrostatographic processing stations during the reproduction cycle.

For the purpose of the present disclosure, the several electrostatographic processing stations in the path of movement of the photoconductive surface which are involved in the electrostatographic reproduction cycle may be described functionally as follows.

A charging station, at which a uniform electrostatic charge is deposited on the photoconductive surface of the endless belt;

An exposure station, at which a light or radiation pattern of copy to be reproduced is projected onto the photoconductive surface to dissipate the surface charge in the exposed areas thereof and thereby form a latent electrostatic image of the copy to be reproduced;

A developing station, at which a developing material including electroscopic toner particles having an electrostatic charge opposite to that of the electrostatic latent image is cascaded over the interior surface of an endless, transparent belt interposed between the developing station and the belt containing the latent electrostatic image, whereby the toner particles adhere to the transparent belt in conformity with the electrostatic latent image on the photoconductive surface to form an electrostatographic powder image on the interior surface of said transparent belt in the configuration of the copy being reproduced;

A viewing station at which the electrostatographic powder image can be viewed;

A transfer station, at which the electrostatographic powder image can be transferred from the interior surface of the transparent belt to a transfer material or support surface; and A discharge station at which the photoconductive surface is exposed to a relatively bright light source to effect substantially complete discharge of any residual electrostatic charge remaining thereon.

The charging station is preferably located as indicated by reference character A. As shown, the charging arrangement includes a corona charging device 21 which includes a corona discharge array of one or more corona discharge electrodes that extend transversely across the belt surface and are energized from a high potential source (not shown) and are substantially enclosed within a shielding member.

Next subsequent thereto in the path of motion of the photoconductive belt is an exposure station B. An optical projection system is provided to project an image derived from a cathode ray tube onto the surface of the photoconductive belt.

The optical projection assembly comprises a cathode ray tube 22 from which emanates a light pattern image which is passed through lens 23 and reflected onto the surface of the photoconductive belt 20 by mirror 24. The belt can be rotated by a motor and clutch (not shown) through the various stations described herein to present a graphic display of the image at the viewing station. As the belt is rotated, clean portions of the photoconductive belt are brought into the imaging station thereby allowing intermittent full frame imaging to occur.

Adjacent to the exposure station is a developing station C in which there is positioned a developer apparatus 25 including a casing or housing having a lower or sump portion for accumulating developer material. A bucket type conveyor 26 is used to carry the developing material to the upper part of the developer housing where it is cascaded over a hopper chute onto an endless transparent belt 27 interposed between said developer apparatus and the surface of the photoconductive belt bearing the electrostatic latent image to effect development of the image thereon. A toner dispenser 28 is used to accurately meter toner to the developing material as toner particles are consumed during the developing operation.

Positioned next and adjacent to the developing station is the viewing and image transfer station D. The transparent web, containing the developed image on the interior surface thereof, passes around the developer housing to the viewing station 30. At the viewing station, a graphic display of the image is presented for observation. Although the developed image on the interior surface of the transparent web is a mirror reverse image, it appears as a direct image, properly oriented to the viewer, when seen through the transparent web by the viewer. The background against which the image is viewed is the clear surface of a transfer web 32, preferably a white paper web which is closely proximate to, but clear of, the transparent web.

If the operator desires a permanent hard copy of the graphic display, the operator can activate the transfer bar 34 which can contain means 36 for applying transfer pressure and/or means 38 for applying an electrostatic charge to the transfer web. The transfer of the electrostatographic powder image from the transparent web to the transfer web is effected by means of corona transfer device 36 contained within the transfer bar 34 which can be adapted to either vertically (as shown) or horizontally traverse that portion of the transparent web within the viewing station. In operation, the electrostatic field created by the corona transfer device is effective to tack the transfer web electrostatically to the image-bearing surface of the transparent web. Simultaneously with the tacking action, the electrostatic field is effective to attract the toner particles comprising the electrostatographic powder image from the transparent web and cause them to adhere electrostatically to the surface of the transfer web. Additionally, said transfer bar applies sufficient pressure to aid said imagewise transfer of the powder image to the transfer web. Thus, as the transfer bar moves down the viewing station, transfer of the powder image to the transfer web is effected. Upon completion of its traverse of the viewing station, the transfer bar 34 automatically returns to its initial position. The transfer web, now containing the desired image, is moved out of the viewing station to a fusing zone and tear bar wherein the image is fixed or fused to the transfer web, for example, by the application of heat. The permanent hard copy can then be torn off the roll of transfer webbing.

The next and final station in the apparatus is a cleaning station having positioned therein a corona preclean device 40, which, when activated, imposes a charge of opposite polarity onto the transparent web effecting a loosening of the toner particles thereon. If any residual toner remains on the transparent web after transfer to the transfer web, or if a hard copy of the graphic display is not desired and reuse is sought of the surface of the transparent web for interposition development as described hereinabove, the preclean device 40 can be activated to loosen the toner particles and the transparent web containing the loosened toner particles can be passed into the developer zone where the scrubbing action of development removes the residual toner while the new image is made visible. Any residual charge remaining on the photoconductive plate 20 can be dissipated by exposing the plate to an appropriate light source 46 prior to recharging the plate to commence another cycle.

Figure 2:
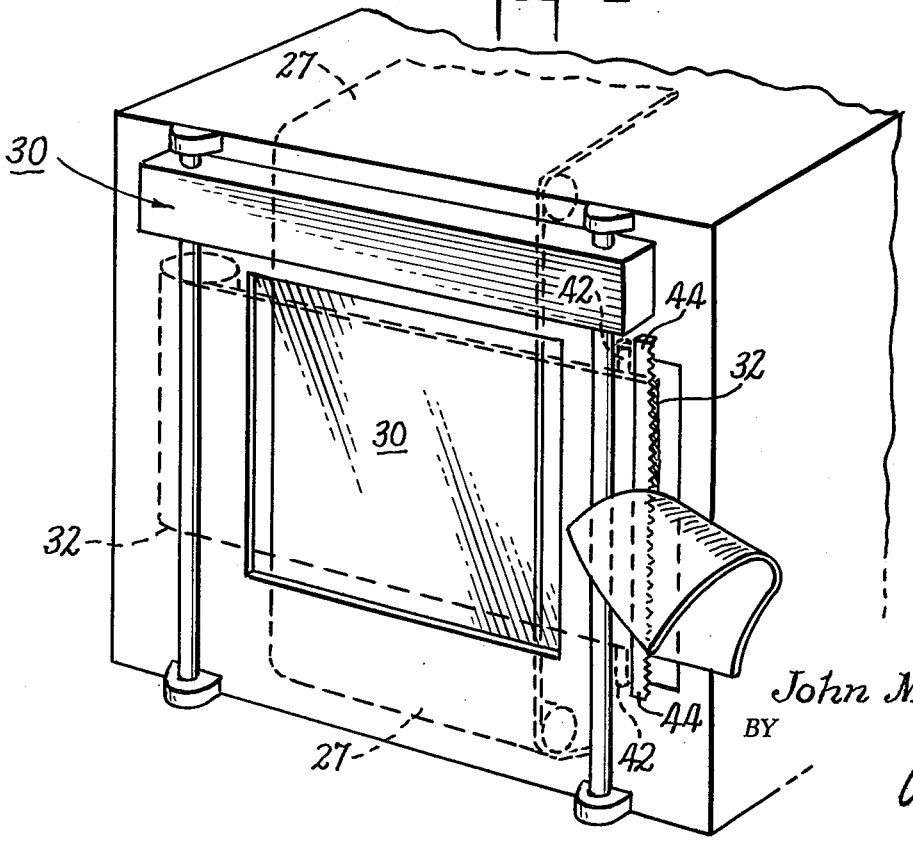
FIG. 2 is a left end view which schematically illustrates the viewing and transfer stations of the apparatus.

Referring now to FIG. 2, there is shown schematically an end view of the housing containing the viewing and large transfer station D. The endless transparent web 27 containing the developed image on the interior surface thereof is sequentially passed into the viewing station 30 wherein the resulting graphic display can be temporarily viewed by the operator. Transfer web 32, shown as a roll of white paper, although it could also be a stack of paper sheets, is passed at right angles to the transparent web 27 and behind it so as to clear said web. The presence of the transfer web behind the transparent web containing the developed image provides the background against which the image can be viewed. If the operator desires to make a permanent hard copy of the temporary graphic display, the transfer bar 34 can be activated either manually or automatically by the operator causing the transfer bar 34 to traverse the viewing station. As described hereinabove, the transfer bar 34 can contain a corona transfer device 38 which, when activated, causes the transfer web to be tacked or brought into contact with the powder image on the interior surface of the transparent web 27. In addition, the electrostatic field which is generated attracts the toner particles, in image configuration, from the transparent web to the transfer material. A pressure roll 36 can be additionally associated with said transfer bar to create pressure contact between the two webs thereby assisting transfer. Preferably, a grounded conductive backing plate 45 is affixed behind the transfer web 32 within the region of the viewing station to both assist in generating the necessary pressure between the two webs and to complete the circuit of the corona transfer device 38. Once the image has been transferred to the transfer web, the transfer web is passed under fixing or fusing zone 42 wherein the image is permanently fixed to the transfer web. Finally, the resulting copy sheet is passed out of the housing under tear bar 44 wherein it can be separated from the roll by the operator. Upon completion of image transfer or after viewing the graphic display, the transparent web containing either residual toner particles or the powder image itself, if no copy is made, is passed out of the viewing station, continuing its endless loop around the developer housing into the cleaning station. The cleaning station can contain a corona preclean device 40, if desired, to effect a loosening of the toner particles prior to reentry of the transparent web into the developing zone. Within the developing zone, it has been found that the cascade nature of the development or the action of a magnetic brush or other development system, is sufficient to remove the residual toner particles on the image and thereby enable the web to be reused for subsequent imaging cycles.

The electrostatographic plate employed in the present invention includes a photoconductive layer on a conductive backing formed in the shape of an endless belt. The photoconductive layer comprises a photoconductive insulating material which may be employed alone or dispersed in a high electrical resistance binder. Typical photoconductive insulating materials which may be used without a binder include: vitreous selenium, sulfur, anthracene, and mixtures thereof. Typical photoconductive materials which may be employed in an insulating binder include: sulfur, vitreous selenium, amorphous alpha monoclinic selenium, zinc sulfide, zinc oxide, zinc cadmium sulfide, zinc magnesium oxide, cadmium selenide, zinc silicate, calcium-strontium sulfide, cadmium sulfide, mercuric iodide, mercuric oxide, mercuric sulfide, indium trisulfide, gallium triselenide, arsenic disulfide, arsenic trisulfide, arsenic triselenide, antimony trisulfide, cadmium sulfoselenide, doped calcogenides of zinc and cadmium (O,S,Se,Te), aluminum oxide, bismuth oxide, molybdenum oxide, lead oxide, molybdenum iodide, molybdenum selenide, molybdenum sulfide, molybdenum telluride, aluminum iodide, aluminum selenide, aluminum sulfide, aluminum telluride, bismuth iodide, bismuth selenide, bismuth sulfide, bismuth telluride, cadmium telluride, mercuric selenide, mercuric telluride, lead iodide, lead selenide, lead sulfide, lead telluride, cadmium arsenide, lead chromate, gallium sulfide, gallium telluride, indium sulfide, indium selenide, indium telluride, red lead ($Pb_3O_4$), triphenyl amine, 2,4-bis(4,4'-diethylaminophenyl)-1,3,4-oxadiazole, N-isopropylcarbazole triphenylpyrrole, 4,5-diphenylimidazolidinone, 4,5-diphenylimidazolidinethione, 4,5-bis(4'-aminophenyl)-imidazolidinone, 1,5-cyanonaphthalene, 1,4-dicyanonaphthalene, aminophthalodinitrile, nitrophthalidinitrile, 1,2,5,6-tetraazacyclooctatertraene-(2,4,6,8), 3,- 4-di(4'-methoxy-phenyl)-7,8-diphenyl-1,2,5,6-tetraazacyclooctatetraene-(2,4,6,8), 3,4-di-(4'-phenoxy-phenyl)-7,8-diphenyl-1,2,5,6-tetraazacyclooctatetranene-(2,4,6,8), 3,4,7,8,-tetramethoxy-1,2,5,6-tetraazacyclooctatetraene-(2,4,6,8), 2-mercapto-benzthiazole, 2-phenyl-4-alpha-naphthylideneoxazolone, 2-phenyl-4-diphenylideneoxazolone, 2-phenyl-4-p-methoxybenzylidene oxazolone, 6-hydroxy-2 phenyl-3-(p-dimethyl-amino-phenyl)-benzofurance, 6-hydroxy-2,3-di(p-methoxyphenyl)-benzofurance, 2,-3,5,6-tetra-(p-methoxyphenyl)-furo-(3,2')-benzofurane, 4-dimethylamino-benzylidene-benzhydrazide, 4-dimethylaminobenzylidene-isonicotinic acid hydrazide, furfurylidene(2)-4'-dimethylamino-benzhydrazide, 5-benzilidene-amino-acenaphthene, 3-benzylidene-amino-carbazole, (4-N,N-dimethyl amino-benzylidene) -p-N,N-dimethylamino-aniline, (2-nitro-benzyliden)-p-bromoaniline, N,N-dimethyl-N'-(2-nitro-4-cyano-benzylidene)-p-phenyl-enediamine, 2,4-diphenyl-quinazoline, 2-(4'-amino-phenyl)-4-phenyl-quinazoline, 2-phenyl-4-(4'-dimethylaminophenyl)-7-methoxyquinazoline, 1,3-diphenyltetrahydroimidazole, 1,3-di-(4'-chlorophenyl)-tetrahydroimidazole, 1,3-diphenyl-2-(4'-dimethyl amino phenyl-tetrahydroimidazole, 1,3-di-(p-tolyl)-2-(quinol-2-yl)-tetrahydroimidazole, 3-(4'-dimethylaminophenyl)-5-(4''-methoxyphenyl)-6-phenyl-1,2,4-triazine, 3-pyridyl(4''-dimethylaminophenyl)-6-phenyl-1,2,4-triazine, 3-(4'-aminophenyl)-5,6-diphenyl-1,2,4-triazine, 2,5-bis[4-aminophenyl-(1')]-3,4-triazole, 2,5-bis[4'-N-ethyl-acethlamino-phenyl-(1')]-1,3,4-triazole, 1,5-diphenyl-3-methylpyrazoline, 1,3,45-tetraphenyl-pyrazoline, 1-phenyl-3-(p-methoxystyryl)-5-(p-methoxyphenyl)-pyrazoline, 2-(4'-dimethylamino phenyl)-benzoxazole, 2-(4'-methoxyphenyl)-benzthiazole, 2,5-bis-[p-aminophenyl-(1)]-1,3,4-oxadiazole, 4,5-diphenyl-imidazolone, 3-aminocarbazole, and mixtures thereof.

Any suitable high resistance binder may be employed to suspend the photoconductive material. A film-forming binder material having a relatively high dielectric constant and high dielectric strength is preferred. Typical film-forming materials include: polyolefins such as polyethylene, polypropylene and chlorinated polyethylene; vinyl and vinylidene resins such as polystyrene, polyvinyl pyrrolidone, acrylic polymers, polyvinyl acetate, polyvinyl butyral, and polyvinyl chloride; fluorocabons such as polytetrafluorethylene and polychlorotrifluoroethylene; styrene-butadiene, heterochain thermoplastics such as polyamides, polyesters, and polycarbonates; phenolic resins such as phenol-formaldehyde and resorcinol-formaldehyde; melamineformaldehyde resins such as methylol melamine resins, dimethyl trimethylol melamine resins, and trimethylol melamine resins; silicone resins; epoxy resins; and mixtures thereof. Any suitabl additives such as emulsifiers, wetting agents, pH regulators, brightening agents and stabilizers may be admixed with the film-forming binder.

The transparent web employed in the present invention can be any transparent flexible plastic material having sufficient strength and integrity to be repeatedly cycled over a plurality of engaging means such as rollers, sprocket wheels and the like, adapted to engage the margins of said transparent web without interfering with the developed image thereon. Preferably, transparent plastic webs exhibiting a dielectric constant ranging from about 3 to about 8 and a volume resistivity ranging from about $10^{14}$ to about $10^{16}$ ohm-cms. are employed. The web thickness can range from about 1 to about 10 mils and preferably is about 2 mils. Illustrative plastic materials useful for the transparent webs of the present invention are Mylar, Tedlar, Teflon, nylon, cellulose acetate, poly(vinylidene fluoride), vinyl chloride-vinyl acetate copolymers and the like; most preferably, a Tedlar web having a thickness of 2 mils is employed.

Thus, the present invention provides a compact, but flexible apparatus which enables direct viewing of an image prior to copying and a simplified and convenient method of obtaining hard copies of said image. Other modifications of the present invention will occur to those skilled in the art upon a reading of the present disclosure. These are intended to be included within the scope of this invention.

What is claimed is:

1. Method for electrostatographic production of a temporary graphic display and conversion thereof to permanent hard copy comprising:

forming a latent electrostatic image on a photoconductive surface;

contacting said surface with a transparent continuous insulating web;

contacting the surface of the transparent web opposite that in contact with the latent image with electroscopic toner particles which electrostatically cling to the transparent web in conformity with said latent electrostatic image;

passing the developed image on the transparent web to a viewing station at which said developed image can be temporarily graphically displayed;

transferring said developed image to a transfer web being adapted to contact the surface of the transparent web containing the developed image, and fusing said developed image onto said transfer web thereby forming a permanent copy of said image.

2. Method as defined in claim 1 wherein said developed image is electrostatically transferred to the transfer web.

3. Method as defined in claim 1 wherein pressure is applied to said developed image causing said image to be transferred to the transfer web.

4. Method as defined in claim 3 wherein an electrostatic field is applied to said transfer web during image transfer.

5. Method as defined in claim 1 wherein the attraction of any residual toner to the transparent web is decreased prior to development of the latent electrostatic image by imposing a charge of opposite polarity onto the transparent web.

6. Method as defined in claim 1 wherein any residual charge remaining on the photoconductive surface after development of the image is dissipated by exposing said surface to a light source.

7. Method as defined in claim 1 wherein the transparent web is a plastic material exhibiting a dielectric constant ranging from about 3 to about 8 and a volume resistivity ranging from about $10^{14}$ to about $10^{16}$ ohm-cm.

8. Method as defined in claim 1 wherein the transparent web has a thickness ranging from about 1 to about 10 mils.

9. The method of claim 1 wherein said transfer web is positioned with respect to said transparent web at said viewing station for establishing a background field which increases the contrast of the image being viewed.

10. The method of claim 9 wherein said transfer web and said transparent web are advanced in mutually perpendicular directions.

* * * * *

UNITED STATES PATENT AND TRADEMARK OFFICE

CERTIFICATE OF CORRECTION

PATENT NO. : 3,955,977

DATED : May 11, 1976

INVENTOR(S) : John M. Bailey, Jr.

It is certified that error appears in the above-identified patent and that said Letters Patent are hereby corrected as shown below:

Column 4, line 61, "large" should read --image--.

Column 6, line 41, insert -- N- -- at the end of the line.

Column 6, line 43, insert --,-- between "4" and "5".

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*